US005103041A

United States Patent [19]

A'Court et al.

[11] Patent Number: 5,103,041

[45] Date of Patent: Apr. 7, 1992

[54] CARBAMATES, THEIR PRODUCTION AND USE AS FUELS ADDITIVES

[75] Inventors: Richard A'Court, Beverley; William J. Fox, London; John E. Hamlin; Sean P. O'Connor, both of Hull, all of England

[73] Assignee: BP Chemicals Limited, London, England

[21] Appl. No.: 305,724

[22] PCT Filed: Jun. 23, 1988

[86] PCT No.: PCT/GB88/00494

§ 371 Date: Jan. 31, 1989

§ 102(e) Date: Jan. 31, 1989

[87] PCT Pub. No.: WO88/10250

PCT Pub. Date: Dec. 29, 1988

[30] Foreign Application Priority Data

Jun. 25, 1987 [GB] United Kingdom ..... 8714872
Jun. 25, 1987 [GB] United Kingdom ..... 8714873
Jun. 25, 1987 [GB] United Kingdom ..... 8714874

[51] Int. Cl.[5] ..... C07C 125/04

[52] U.S. Cl. ..... 560/132; 44/387; 44/329; 560/157

[58] Field of Search ..... 560/132, 157; 44/387

[56] References Cited

U.S. PATENT DOCUMENTS

| | | | |
|---|---|---|---|
| 4,236,020 | 11/1980 | Lewis et al. | 44/71 |
| 4,268,683 | 5/1981 | Gurgiolo | 560/24 |
| 4,268,684 | 5/1981 | Gurgiolo | 560/24 |
| 4,537,986 | 8/1985 | Reissenweber et al. | 560/132 |
| 4,659,845 | 4/1987 | Rivetti et al. | 560/132 |
| 4,725,680 | 2/1988 | Barcelo et al. | 560/132 |

*Primary Examiner*—Jacqueline V. Howard
*Attorney, Agent, or Firm*—Brooks Haidt Haffner & Delahunty

[57] ABSTRACT

A process for the production of a carbamate having formula (I), wherein X and Y are independently either hydrogen, a hydrocarbyl group or a hetero-substituted hydrocarbyl group or the group of formula (II), wherein Z is either a divalent hydrocarbyl, a substituted hydrocarbyl group or the group of formula (III) [(alkylene)m(NH)n(alkylene)m] in which n=0 to 4 and m=1 to 4, and R is a hydrocarbyl or substituted hydrocarbyl group, provided that if either one of X or Y is the group of formula (II), the other of X or Y is hydrogen, which process comprises reacting a compound of formula (IV), wherein X and Y are independently either hydrogen, a hydrocarbyl group or a hetero-substituted hydrocarbyl group with a dihydrocarbyl carbonate having formula (V), wherein independently R is as defined above in the presence as catalyst of a strong organic base and in the proportions necessary to produce either a mono-carbamate or a bis-carbamate.

9 Claims, No Drawings

CARBAMATES, THEIR PRODUCTION AND USE AS FUELS ADDITIVES

The present invention relates to novel carbamates, their production and their use as fuels additives.

Carbamates are useful in agrochemicals, resins, plasticisers and monomers. A number of therapeutic applications include use as antipyretics, diuretics and antiseptics. A widely used method for the production of carbamates is the reaction of an alkyl isocyanate with an alcohol. A disadvantage of this method is that alkyl isocyanates are highly toxic materials. Other reported methods for producing carbamates are disclosed in Japan Kokai 77, 14745 wherein NaOMe/MeOH, $PhNH_2$ and $(MeO)_2$ CO are reacted to produce $PhNHCO_2Me$, Japan Kokai 79, 163528 which discloses a similar reaction using NaOMe, piperidine, imidazole, carbonyldiimidazole, N-methylpyrolidone or morpholine, U.S. Pat. No. 4,258,683 wherein aromatic amines are reacted with organic carbonates in the presence of zinc and stannous salts, and U.S. Pat. No. 4,268,684 wherein there is disclosed a similar reaction to that of U.S. Pat. No. 4,268,683 except that cobaltous salts are used instead of zinc and stannous salts.

Carbamates have also been used as additives to fuels. A specific problem thought to involve deposit formation in the combustion chamber is that of octane requirement increase (generally abbreviated to ORI). The problem of ORI is addressed by U.S. Pat. No. 4,236,020, the solution to the problem according to the aforesaid U.S. Patent being to add to the fuel a poly(oxyalkylene)-carbamate soluble in a hydrocarbon fuel boiling in the gasoline range. The carbamates of U.S. Pat. No. 4,236,020 comprise a hydrocarbyloxy-terminated poly-(oxyalkylene) chain of at least 5 oxyalkylene units containing 2 to 5 carbon atoms per oxyalkylene unit bonded through an oxycarbonyl group to a nitrogen atom of ethylenediamine. Preferred carbamates are those described by the general formula:

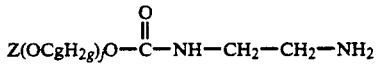

in which g is an integer 2 to 5, j is an integer such that the molecular weight of the compound is in the range of about 1,200 to about 5,000, Z is a hydrocarbyl of 1 to 30 carbon atoms and sufficient of the oxyalkylene units in the compounds are other than ethylene to render the compounds soluble in hydrocarbon fuels boiling in the gasoline range. The only method disclosed for preparing the carbamates is the reaction of a suitable capped polyether alcohol with phosgene to form a chloroformate followed by reaction of the chloroformate with ethylene diamine to form the active carbamate. A problem associated with this route to carbamates is the use of phosgene which not only is highly toxic but also can lead to products contaminated with chlorine.

We have now found an improved process for the production of carbamates wherein strong organic bases are used as the catalyst.

Accordingly, in a first aspect, the present invention provides a process for the production of a carbamate having the formula:

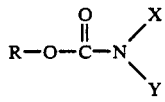

(I)

wherein X and Y are independently either hydrogen, a hydrocarbyl group or a hetero-substituted hydrocarbyl group or the group of formula:

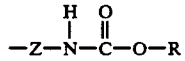

(II)

wherein Z is either a divalent hydrocarbyl or substituted hydrocarbyl group or a group of the formula:

$$[(\text{alkylene})_m(\text{NH})_n(\text{alkylene}_m] \quad \text{(III)}$$

in which n=0 to 4 and m=1 to 4, and

R is a hydrocarbyl or substituted hydrocarbyl group, provided that if either one of X or Y is the group of formula (II), the other of X or Y is hydrogen, which process comprises reacting either a compound of the formula:

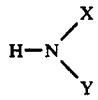

(IV)

wherein X and Y are independently either hydrogen, a hydrocarbyl group, or a hetero-substituted hydrocarbyl group, with a dihydrocarbyl carbonate having the formula:

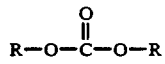

(V)

wherein independently R is as defined above in the presence as catalyst of a strong organic base and in the proportions necessary to produce either a mono-carbamate or a bis-carbamate.

Preferably at least one mole of the compound of formula (IV) per mole of the dihydrocarbyl carbonate of formula (V) is employed.

The compound of formula (IV) may be either ammonia (X=Y=H), a primary amine (either of X or Y=H) or a secondary amine (neither of X or Y=H). The amine may suitably be either a monoamine or a polyamine. X and Y may be independently either a hydrocarbyl group of a hetero-substituted hydrocarbyl group. Suitably the hydrocarbyl group may be an aliphatic hydrocarbyl group, of which alkyl groups are preferred. Examples of suitable hydrocarbyl groups include methyl, ethyl, propyl or butyl groups. Alternatively, X and Y may be independently a hetero-substituted hydrocarbyl group. Suitably, the hetero-substituted hydrocarbyl group may be an aliphatic hydrocarbyl group substituted by nitrogen or oxygen, preferably a group of the formula -P-Q, wherein P is an alkylene or polyalkylene group, for example a $C_1$ to $C_4$ alkylene group or a poly- $C_1$ to $C_4$ alkylene group, and Q is either an $NH_2$, —OH or a heterocyclic group, for example morpholine or piperazine, or a substituted heterocyclic group, for example pipecoline. Examples of suitable compounds (IV) wherein X and Y are independently hetero-substituted hydrocarbyl groups include alkanolamines, for example ethanolamine, and compounds of formula (IV) wherein:

$X = H$ and $Y = CH_2CH_2NH_2$ (i)

(ii)

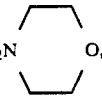

$X = H$ and $Y = CH_2CH_2CH_2N$ O, and (iii)

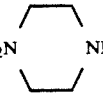

$X = H$ and $Y = CH_2CH_2CH_2N$ NH.

Finally, the compound (IV) in which X and Y are independently hetero-substituted hydrocarbyl groups, may be an alkylene polyamine or a polyalkylene polyamine, suitably wherein the alkylene group is a $C_1$–$C_4$ alkylene group, for example ethylene diamine, diethylene triamine, triethylene tetramine, and the like.

In the dihydrocarbyl carbonate of formula (V) the groups R are independently hydrocarbyl groups which may suitably be alkyl groups, preferably $C_1$ to $C_4$ alkyl groups, more preferably methyl groups. Alternatively, the dihydrocarbyl carbonate of formula (V) may be a cyclic carbonate, for example ethylene carbonate or propylene carbonate.

The process may be operated in the presence or absence of an added solvent. Suitable solvents include liquid hydrocarbon solvents, for example the mixed aromatic solvent designated A260 commercially available from BP Chemicals Limited.

The catalyst is a strong organic base. A preferred strong organic base is an amidine. By the term amidine is meant a compound containing the grouping:

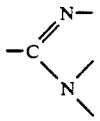

wherein the free valencies on the nitrogen atoms are attached to either carbon atoms or hydrogen and the free valency on the carbon atom is attached to either another carbon atom or nitrogen. In the case that the free valency on the nitrogen is attached to nitrogen the amidine is a guanidine.

A preferred class of amidine is the cyclic amidines. Cyclic amidines are defined as those amidines wherein at least one of the nitrogen atoms is part of an alicyclic or heterocyclic substituted or unsubstituted hydrocarbyl ring. In the case where the amidine is a guanidine then any two or the three nitrogen atoms may be in the same or different rings. Those nitrogen atoms which are not part of any said ring may form part of a substituted or unsubstituted hydrocarbyl group.

A preferred class of cyclic amidine is that in which the amidine group can form part of a fused ring system containing 6 and 5 membered rings or 6 and 7 membered rings or two six membered rings, as for example in 1,5-diazabicyclo [4.3.0] non-5-ene (DBN) which has the formula

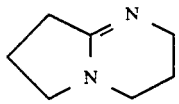

or 1,8-diazabicyclo [5.4.0] undec-7-ene (DBU) of the formula

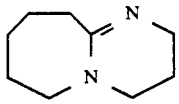

or 1,5,7-triazabicyclo [4.4.0] dec-5-ene (TBD) of formula

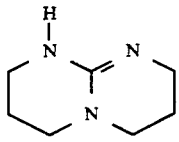

The amidine may be supported on a suitable support. This may be accomplished by deposition of the amidine on a support or by chemical bonding of the amidine to a suitable support. Suitable supported amidine catalysts are described in, for example, our EP-A-0168167.

As an alternative to an amidine, the strong base may comprise a Lewis base and an epoxide. The term Lewis base is generally understood to mean a compound containing an unshared pair of electrons capable of sharing with an acid. The terms Lewis base and amidine are not therefore mutually exclusive. The Lewis base may suitably be an organic compound containing trivalent nitrogen or phosphorus, for example an amine or a phosphine. The epoxide may suitably be a substituted or unsubstituted $C_2$ to $C_8$ alkylene oxide, preferably either ethylene oxide, propylene oxide or butylene oxide.

As regards the reaction conditions, the process may suitably be operated at a temperature in the range from 0° to 100° C., more preferably from 15° to 75° C., most preferably from 20° to 25° C., and the pressure may be either atmospheric or superatmospheric, for example from 1 to 10 bar.

The process may be operated batchwise or continuously, preferably continuously.

An advantage of using the process of the present invention for the production of carbamates is that it avoids the use of phosgene and its associated disadvantages.

The group R in the carbamate of formula (I) can be exchanged for a group $R^1$ by a process which comprises reacting the carbamate of formula (I) with a compound of the formula:

$$R^1OH \quad \text{(VI)}$$

wherein $R^1$ is a hydrocarbyl or hetero-substituted hydrocarbyl group different from R, in the presence as catalyst of either a strong organic base or a tetrahydrocarbyl titanate.

The group $R^1$ in the compound of formula (VI) may suitably be any of the groups R as defined for the carbamate of formula (I), provided it is not identical to the group R. Hydrocarbyl groups substituted with nitrogen and/or oxygen, for example hydrocarbyl polyether groups, may be used.

In a preferred embodiment of the present invention there is provided a process for the production of a carbamate suitable for used as a detergent additive to internal combustion engine fuels wherein the group $R^1$ in the compound of formula (VI) is a hydrocarbyl or heterosubstituted hydrocarbyl group of a molecular weight and composition such as to impart fuel solubility.

A preferred compound of formula (VI) for this purpose is a polyalkyene glycol (PAG) formed by the reaction of a hydroxylic compound, which may be either an alcohol, or a phenol with an alkylene oxide, and may suitably have a molecular weight in the range from about 500 to 10,000, preferably from 1200 to 5000. PAGs are more fully described in the aforesaid U.S. Pat. No. 4,236,020, the disclosure of which in respect of suitable PAGs is incorporated by reference herein. The PAG should contain sufficient oxyalkylene units other than ethyleneoxy to effect solubility in internal combustion engine fuels. A particularly suitable compound of formula (VI) for use in the process of the invention is a polyoxyalkylene glycol obtained by the reaction of p-dodecylphenol with butylene oxide and having a molecular weight of about 2,000, which material is commercially available as BREOX (RTM) PC 1362 from Hythe Chemicals Limited. Another preferred class of compound of formula (VI) suitable for use in the production of detergent additives is polyalkylene glycols produced by the hydroxyalkylation, suitably by reaction with alkylene oxides, of amines, for example ethylene diamine or aminopropylmorpholine.

As catalyst for the exchange reaction there is used either a strong organic base or a tetrahydrocarbyltitanate. Suitable strong organic bases are those as hereinbefore described in relation to the preparation of carbamates of the formula (I). The same strong organic base or a different strong organic base, preferably the same, may be used in the exchange reaction as in the preparation of the carbamate of formula (I). Suitably the tetrahydrocarbyltitanate may be a tetraalkyltitanate. Suitably the alkyl group of the tetraaalkyltitanate may be a $C_1$ to $C_4$ alkyl group. An example of a suitable tetraalkyltitanate is tetraisopropyltitanate.

It is preferred to react the compound of formula (I) with the compound of formula (VI) in the presence of a suitable solvent. Suitably the solvent may be a hydrocarbon solvent, for example the mixed aromatic hydrocarbon solvent identified as A260 which is commercially available from BP Chemicals Limited.

As regards the reaction conditions for reacting the compound of formula (I) with the compound of formula (VI), the temperature may suitably be elevated, preferably in the range from 100° to 300° C., and the pressure may be either atmospheric or superatmospheric.

A particular advantage of the process claimed for the production of detergent additives is that it provides a chlorine-free product, in contrast to prior art processes, such as that of U.S. Pat. No. 4,236,020.

In another aspect the present invention provides an internal combustion engine fuel concentrate composition comprising as a first component from 1 to 95% by weight of a carbamate of the formula (I) wherein the group R is a hydrocarbyl or substituted hydrocarbyl group of a molecular weight and composition such as to impart fuel solubility as produced by a process as hereinbefore described and as a second component a fuel compatible solvent therefor.

The fuel compatible solvent for the compound of the formula (II) may suitably be an internal combustion engine fuel.

Preferably the carbamate is a mono-carbamate.

In another aspect the invention comprises an internal combustion engine fuel composition comprising a major proportion of an internal combustion engine fuel and a minor proportion of the concentrate composition as hereinbefore described.

The amount of the concentrate composition present in the fuel composition may suitably be such as to provide a concentration of the compound of formula (I) in the fuel composition in the range from 10 to 10,000 p.p.m. by weight.

The internal combustion engine fuel is preferably a fuel boiling in the gasoline range. The fuel composition may incorporate additives conventionally employed in fuels compositions. Such additives may be incorporated either into the fuel concentrate or directly into the fuel composition.

In another aspect the present invention provides as novel compounds carbamates of the formula (I) other than those disclosed in U.S. Pat. No. 4,236,020 and in particular those wherein X and Y are independently the group of formula -P-Q as hereinbefore described and their reaction products with a compound of formula (VI), suitably wherein $R^1$ is a hydrocarbyl or heterosubstituted hydrocarbyl group of a molecular weight and composition such as to impart fuel solubility.

The invention will now be further illustrated by reference to the following Examples.

PREPARATION OF MONOCARBAMATE OF THE FORMULA (I)

EXAMPLE 1

Dimethylcarbonate (9.0 g) and n-butylamine (7.3 g) were mixed with TBD (0.05 g) and allowed to stand at room temperature. After 6 h a sample of the liquid product was shown, by gc/ms, to be methyl N-(n-butyl) carbamate (95% yield).

EXAMPLE 2

Dimethylcarbonate (9.0 g) and n-propylamine (5.9 g) were mixed with TBD (0.05 g) according to Example 1. The product was shown by gc/ms to be methyl N-(n-propyl) carbamate (93% yield).

EXAMPLE 3

Dimethylcarbonate (9.0 g) and ethanolamine (4.7 g) were mixed with TBD (0.05 g) according to Example 1. The product was shown by gc/ms to be methyl N-(2-hydroxyethyl) carbamate (86% yield).

EXAMPLE 4

Example 1 was repeated replacing the dimethylcarbonate with diethylcarbonate (9.2 g). The liquid product was shown by gc/ms to be ethyl N-(n-butyl)carbamate. (92% yield).

Comparison Test 1

Example 1 was repeated in the absence of TBD. Only starting material was recovered.

Comparison Test 2

Example 1 was repeated replacing the TBD with triethylamine (0.05 g). The liquid product was shown by gc/ms to be methyl N-(n-butyl) carbamate (6% yield).

EXAMPLE 5

Example 1 was repeated replacing TBD with DBU. The liquid product was shown by gc/ms to be methyl N-(n-butyl) carbamate (65% yield).

EXAMPLE 6

Example 1 was repeated replacing TBD with DBN. The liquid product was shown by gc/ms to be methyl N-(n-butyl) carbamate (30% yield).

EXAMPLE 7

A mixture of ethanolamine (50.6 g), dimethylcarbonate (74.8 g), TBD (1.0 g) and m-xylene (10 ml) was refluxed for 3 hours (ca. 80° C.). The mixture was evaporated under reduced pressure giving the product as a clear liquid (84 g). NMR analysis indicated the product to be methyl [N-(2-hydroxyethyl)] carbamate.

EXAMPLE 8

A mixture of N-(2-aminoethyl) piperazine (28 g), dimethylcarbonate (20 g) and TBD (1.0 g) was left to stand open to the atmosphere for 120 hours. The mixture was evaporated under reduced pressure giving the product (38.75 g) identified by NMR to be methyl N-[2-($N^1$-piperazino)ethyl] carbamate.

EXAMPLE 9

A mixture of N-(3-aminopropyl) pipecoline (37.1 g), dimethylcarbonate (23.0 g) and TBD (1.0 g) was allowed to stand open to the atmosphere for 120 hours. The mixture was evaporated under reduced pressure giving the product (46.1 g), identified by NMR to be methyl N-[3-($N^1$-pipecolino)propyl] carbamate.

EXAMPLE 10

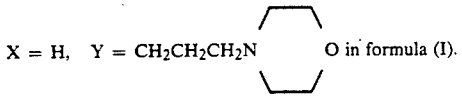

Step (A)

A mixture of N-(3-aminopropyl) morpholine (57.1 g), dimethyl carbonate (42 g) and TBD (1.0 g) was refluxed for 6 hours with a nitrogen sparge. The resultant mixture was evaporated under reduced pressure to give the product as a clear yellow liquid (74 g). NMR analysis indicated the product to be methyl N-[3-($N^1$-morpholino) propyl] carbamate.

Step (B)

The intermediate carbamate from Step A (16.5 g), BREOX PC 1362 (114 g) and TBD (1.0 g) were stirred at 150° C. for 3.5 hours with a nitrogen sparge. The mixture was cooled, treated with toluene (50 ml) and magnesium sulphate (1.0 g) and allowed to stand. The mixture was then filtered and evaporated under reduced pressure to give the product as a clear pale yellow liquid.

Analysis: % Nitrogen found = 1.46.

EXAMPLE 11

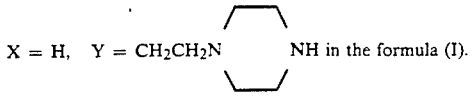

Step (A)

A mixture of N-(2-aminoethyl)piperazine (20 g), dimethylcarbonate (33.6 g) and DBU (0.2 g) was stirred at 80°-120° C. for 2 hours with a nitrogen sparge. The mixture was cooled and filtered to give the product as a clear orange-yellow liquid. NMR analysis indicated the product to be methyl N-[2-($N^1$-piperazino) ethyl] carbamate.

Step (B)

The intermediate carbamate product from Step A (10.8 g, containing DBU catalyst carried through from Step A) and BREOX PC 1362 (136 g) were stirred at 120°-140° C. for 3 hours with a nitrogen sparge. The product was cooled and filtered to give a clear yellow liquid.

Analysis: % Nitrogen = 1.10.

EXAMPLE 12

A mixture of methyl N-[3-($N^1$-morpholino)propyl] carbamate (the intermediate product obtained from Example 10, Step A) (10 g), 1-octanol (15.0 g), m-xylene (25 ml) and TBD (0.2 g) was refluxed for 1 hour. The mixture was evaporated under reduced pressure giving the product as a light yellow liquid (30.4 g). NMR analysis indicated the product to be n-octyl N-[3-($N^1$-morpholino)propyl] carbamate.

EXAMPLE 13

A mixture of methyl N-[3-($N^1$-morpholino)propyl] carbamate (the intermediate product obtained from Example 10, Step A) (5.2 g), polyalkylene glycol (PAG B225 from Hythe Chemicals Limited) (49.5 g), TBD (0.4 g) and m-xylene (33.4 g) was stirred at 140° C. with a nitrogen sparge for 2 hours. The mixture was evaporated under reduced pressure giving the product as a viscous yellow liquid (45 g).

EXAMPLE 14

A mixture of methyl N-[2-($N^1$-piperazino)ethyl] carbamate (the product of Example 8) (5.8 g), 1-octanol (4.3 g) and TBD (0.6 g) was heated at 150° C. for 2 hours. The mixture was evaporated under reduced pressure giving a red-brown product (8.2 g), indicated by NMR analysis to be n-octyl N-[2-($N^1$-piperazino)ethyl] carbamate.

EXAMPLE 15

A mixture of methyl N-[3-($N^1$-morpholino)propyl] carbamate (the intermediate product obtained from Example 10, Step A) (16.0 g), BREOX PC 1470 [(ex Hythe Chemicals Limited, prepared by reaction of p-dodecylphenol (1 mole) with butylene oxide (15 moles)] (10.35 g) and TBD (0.9 g) was stirred at 150° C. with a nitrogen sparge for 4.25 hours. The mixture was then cooled and treated with toluene (50 ml) and magnesium sulphate (1.0 g) and allowed to stand. The mixture was then evaporated under reduced pressure giving a clear liquid product.

Analysis: % Nitrogen = 1.55.

PREPARATION OF BISCARBAMATE OF THE FORMULA (I)

EXAMPLE 16

Dimethylcarbonate (18.0 g) and bis (3-aminopropyl-)amine (13.1 g) were mixed in a round-bottomed flask with TBD (0.05 g), and allowed to stand at room temperature. After 16 h the contents of the flask had solidified, and this solid was recrystallised from toluene to give white needles, 16.9 g, 96%, mp 105°-107° C. $^1H$ and $^{13}C$ NMR were consistent with structure (I).

EXAMPLE 17

Dimethyl carbonate (25 ml) and bis(aminopropyl)amine (25 ml) were mixed at 20° C. and TBD (0.1 g) was added. A small exotherm was noted and the mixture was allowd to stand for 16 hours. The mixture was then stripped on a rotary evaporator and the solid residue recrystallised from toluene. The product was demonstrated by NMR to be bis[methyl(N-propyl)carbamate]amine.

EXAMPLE 18

Step (A)

Ethylene diamine (6 g) and dimethyl carbonate (18 g) were mixed together in a round bottom flask at 20° C. TBD (0.1 g) was added and the mixture allowed to stand for 24 h. After this time a white solid product was collected and recrystallised from methanol to give bis (methoxycarbonyl) ethylene diamine. NMR and IR spectra were consistent with the desired compound.

Step (B)

Bis(methoxycarbonyl)ethylene diamine (17.8 g) obtained in Step (A) above and BREOX (RTM) PC 1362 (412 g) (ex. Hythe Chemicals Limited) were dissolved in A260 (a mixed aromatics solvent ex BP Chemicals Limited) (0.5 liters) and heated to 160° C. with vigorous overhead stirring for 24 hours in the presence of tetraisopropyl titanate (5 g). A continuous stream of dry nitrogen was passed over the reactants.

The resulting straw yellow liquid was cooled and filtered through a sinter. Its nitrogen content was determined as 0.25%.

EXAMPLE 19

The procedure of Example 18 was repeated except that the BREOX PC 1362 was replaced by PAG B225 (360 g).

The nitrogen content of the product was determined as 0.37%.

EXAMPLE 20

The procedure of Example 18 was repeated except that the BREOX PC 1362 was replaced by PAG B335 (480 g).

The nitrogen content of the product was determined as 0.16%.

ENGINE TESTING

EXAMPLES 21 TO 24

The products of Examples 10, 11, 18 and 19 were evaluated in the Opel Kadett gasoline detergency test at various concentrations.

The Opel Kadett gasoline detergency test is a well-known industry accepted evaluation procedure approved by the Co-ordinating European Council (C.E.C.), Reference No. C.E.C.F.-02-T-79.

The concentrations and test results are given in the following Table.

Comparison Test 3

The procedure of Examples 21 to 24 was repeated using instead of the biscarbamate products of Examples 10, 11, 18 and 19 a commercially available gasoline detergent having a nitrogen content of 0.70%.

The test results are given in the following Table.

TABLE

| Example | Concentration of additive (ppmw/w) | | DETERMINATION* Valve Deposit Wt (mg) | Valve Deposit Rating |
|---|---|---|---|---|
| 21 | (Ex 10) | 233 | 296 (409) | 7.90 (7.0) |
| 22 | (Ex 11) | 320 | 110 (291) | 7.75 (7.42) |
| 23 | (Ex 18) | 500 | 235 (260) | 7.32 (7.02) |
| 24 | (Ex 19) | 500 | 181 (365) | 7.75 (6.62) |
| CT 3 | (—) | 500 | 269 (440) | 7.2 (6.2) |

*base fuel figures in parentheses.

It can be seen from the results presented in the Table that the products of Examples 10 and 11 compare favourably as detergents with the commercial product and that the products of Examples 18 and 19 have moderate detergent activity.

We claim:

1. A process for the production of a carbamate having the formula:

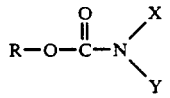

(I)

wherein X and Y are independently either hydrogen, a hydrocarbyl group or a hetero-substituted hydrocarbyl group or the group of formula:

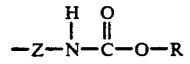

(II)

wherein Z is either a divalent hydrocarbyl, a substituted hydrocarbyl group or the group of formula:

[(alkylene)m(NH)n(alkylene)m] (III)

in which n = 0 to 4 and m = 1 to 4, and R is a hydrocarbyl or substituted hydrocarbyl group, provided that if either one of X or Y is the group of formula (II), the other of X or Y is hydrogen, which process comprises reacting a compound of the formula:

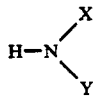

(IV)

wherein X and Y are independently either hydrogen, a hydrocarbyl group or a hetero-substituted hydrocarbyl group with a dihydrocarbyl carbonate having the formula:

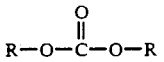

(V)

wherein independently R is as defined above at a temperature in the range of from 0° to 100° C. and a pressure in the range from 1 to 10 bar in the presence as catalyst of an amidine and in the proportions necessary to produce either a mono-carbamate or a bis-carbamate.

2. A process according to claim 1 wherein the compound of formula (IV) is either ammonia, a primary amine or a secondary amine.

3. A process according to claim 2 wherein the compound of formula (IV) is either a monoamine or a polyamine.

4. A process according to either claim 2 or claim 3 wherein X and Y in the formula (IV) is an aliphatic hydrocarbyl group which is an alkyl group.

5. A process according to either claim 2 or claim 3 wherein X and Y in the formula (IV) are independently hetero-substituted hydrocarbyl groups which are aliphatic hydrocarbyl groups substituted by nitrogen or oxygen.

6. A process according to claim 5 wherein the hetero-substituted hydrocarbyl group is a group of the formula -P-Q wherein P is an alkylene group and Q is either $NH_2$, OH or a heterocyclic group.

7. A process according to claim 2 wherein in the dihydrocarbyl carbonate of formula (V) the groups R are independently $C_1$ to $C_4$ alkyl groups.

8. A process according to claim 1 wherein the amidine is a cyclic amidine.

9. A process for the production of a carbamate having the formula:

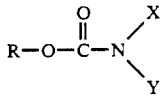

(I)

wherein X and Y are independently either hydrogen or a hydrocarbyl group, and R is a hydrocarbyl or substituted hydrocarbyl group, which process comprises reacting a compound of the formula:

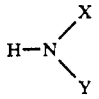

(IV)

wherein X and Y are independently either hydrogen or a hydrocarbyl group with a dihydrocarbonyl carbonate having the formula:

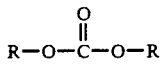

(V)

wherein R independently is as defined above at a temperature in the range of from about 0° to 100° C. and a pressure in the range from about 1 to 10 bar in the presence of an amidine catalyst and in the proportions necessary to produce either a mono-carbamate or a bis-carbamate.

* * * * *

UNITED STATES PATENT AND TRADEMARK OFFICE

CERTIFICATE OF CORRECTION

PATENT NO. : 5,103,041

DATED : April 7, 1992

INVENTOR(S) : RICHARD A'COURT et al

It is certified that error appears in the above-identified patent and that said Letters Patent is hereby corrected as shown below: Title page:

Item (54) and Col. 1, Title should read --"Novel Carbamates"--.

Col. 5, l. 5, correct the spelling of the word "use"

Col. 5, l. 42, correct the spelling of the word "tetr<u>aa</u>lkyltitanate"

Signed and Sealed this

Seventeenth Day of August, 1993

*Attest:*

*Attesting Officer*

BRUCE LEHMAN

*Commissioner of Patents and Trademarks*